US011051665B2

(12) United States Patent
Huang

(10) Patent No.: US 11,051,665 B2
(45) Date of Patent: Jul. 6, 2021

(54) ROLLED SHEET MATERIAL DISPENSER

(71) Applicant: CHIN CHEN JAY CO., LTD., Tainan (TW)

(72) Inventor: Kuo-Tung Huang, Tainan (TW)

(73) Assignee: Chin Chen Jay Co., Ltd., Tainan (TW)

( * ) Notice: Subject to any disclaimer, the term of this patent is extended or adjusted under 35 U.S.C. 154(b) by 384 days.

(21) Appl. No.: 16/145,846

(22) Filed: Sep. 28, 2018

(65) Prior Publication Data

US 2019/0104896 A1 Apr. 11, 2019

(30) Foreign Application Priority Data

Oct. 6, 2017 (TW) ..... 106134561

(51) Int. Cl.

| | |
|---|---|
| ***A47K 10/38*** | (2006.01) |
| ***A47K 10/22*** | (2006.01) |
| ***B65H 16/06*** | (2006.01) |
| ***B65H 16/00*** | (2006.01) |

(52) U.S. Cl.

CPC ..... *A47K 10/38* (2013.01); *A47K 10/22* (2013.01); *B65H 16/005* (2013.01); *B65H 16/06* (2013.01); *A47K 2010/3881* (2013.01); *B65H 2402/54* (2013.01); *B65H 2701/1924* (2013.01)

(58) Field of Classification Search

CPC ..... A47K 10/34; A47K 10/38; A47K 10/22; A47K 2010/3881; B65H 16/06; B65H 16/005; B65H 35/006; B65H 2402/54; B65H 2701/1924; Y10T 225/205; Y10T 225/393

See application file for complete search history.

(56) References Cited

U.S. PATENT DOCUMENTS

| | | | | | |
|---|---|---|---|---|---|
| 2,135,767 | A * | 11/1938 | Price | A47K 10/36 | 242/564.1 |
| 2,298,179 | A * | 10/1942 | Steiner | A47K 10/3656 | 226/131 |
| 3,127,121 | A * | 3/1964 | Babin | A47K 10/36 | 242/596.3 |
| 3,730,409 | A * | 5/1973 | Ratti | A47K 10/36 | 225/14 |
| 4,067,509 | A | 1/1978 | Graham, Jr. et al. | | |
| 4,189,077 | A * | 2/1980 | Hartbauer | A47K 10/3643 | 225/14 |
| 4,690,344 | A * | 9/1987 | Yokota | A47K 10/34 | 225/10 |

(Continued)

FOREIGN PATENT DOCUMENTS

| | | |
|---|---|---|
| TW | I231199 | 4/2005 |
| TW | M448241 U1 | 3/2013 |

*Primary Examiner* — William A. Rivera

(74) *Attorney, Agent, or Firm* — Rosenberg, Klein & Lee

(57) ABSTRACT

A rolled sheet material dispenser, used for dispensing a sheet material on a reel, includes a box and a clamping assembly. The clamping assembly includes a first clamping member, a second clamping member and at least one elastic member. The first clamping member or/and the second clamping member may be a roller. The roller is pivotally connected to the box through a pair of rolling bearings and adjacent to a dispensing opening. The roller is connected with the elastic member so that the roller can be displaced by an elastic force of the elastic member to a clamping position and can be supported by the rolling bearings to clamp the sheet material stably.

8 Claims, 13 Drawing Sheets

(56) References Cited

U.S. PATENT DOCUMENTS

| | | | | |
|---|---|---|---|---|
| 5,452,832 | A * | 9/1995 | Niada | A47K 10/36 225/10 |
| 5,924,617 | A * | 7/1999 | LaCount | A47K 10/3687 225/16 |
| 6,902,134 | B2 * | 6/2005 | Green | A47K 10/38 225/106 |
| 7,258,300 | B2 * | 8/2007 | Rosch | B65H 16/10 242/596.7 |
| 8,177,156 | B1 * | 5/2012 | Rinne | A47K 10/34 242/564.4 |
| 8,231,075 | B2 * | 7/2012 | Troutman | A47K 10/36 242/595 |
| 8,464,976 | B2 * | 6/2013 | Mok | A47K 10/36 242/564.4 |
| 10,165,907 | B1 * | 1/2019 | Troutman | A47K 10/36 |
| 2004/0262837 | A1 * | 12/2004 | Hamada | B65H 5/062 271/272 |
| 2008/0087680 | A1 * | 4/2008 | Amundson | A47K 10/38 221/150 R |

* cited by examiner

ROLLED SHEET MATERIAL DISPENSER

FIELD OF THE INVENTION

The present invention relates to a dispenser, and more particularly to a rolled sheet material dispenser.

BACKGROUND OF THE INVENTION

A dispenser for rolled sheet material is used for dispensing paper towels or cloth towels, and it is widely used. There are some related cases, for example, Taiwan Utility Model Publication No. M448241 titled "paper towel box structure" and Taiwan Utility Model Publication No. M527746 titled "paper towel box".

In general, a dispenser for rolled sheet material mainly comprises a roll of sheet material and a box. The roll of sheet material is formed by winding a sheet material (for example, paper or cloth). The roll of sheet material is pivotally connected to the box. The box has a dispensing opening for dispensing the sheet material. In use, the user can first pull out a section of the sheet material and then tear it off along a tear line for use.

However, when the dispenser for rolled sheet material is used, it is easy to inadvertently pull out an excessive section of the sheet material (for example, when the applied force to pull or tear the sheet material is excessive). The user needs to hold the desired section of sheet material with one end and to tear it off with the other hand. This is inconvenient for use.

In addition, Taiwan Patent Publication No. I231199 discloses a dispenser for rolled paper towel. Wherein, as shown in FIG. 8A and FIG. 8B of this patent, the guiding roller (48) is biased by the spring (170) to abut against the feeding roller (36) to hold the sheet material, but it is not easy to effectively hold the sheet material by the elastic force of the spring (170).

FIG. 10A and FIG. 10B are schematic top views, referring to FIG. 8A and FIG. 8B of Taiwan Patent Publication No. I231199. It is to be noted that if the bushing (E3) and the pivot (E2) are in a tight fit, the starting resistance of the roller (E1) and the pulling resistance are too large, and it is difficult to dispense the sheet material smoothly. Thus, the user has to simultaneously pull both sides of the sheet material with both hands. Therefore, the manufacturer usually provides a certain clearance (E4) at the joint to make the roller (E1) rotate easily; on the other hand, after the bushing (E3) is used for a long time, it is prone to increase the clearance (E4) due to wear and tear.

Referring to FIG. 11A and FIG. 11B, when the user pulls the sheet material (E5), the pivot (E2) of the roller (E1) is displaced eccentrically. The sheet material (E5) cannot be exactly held, resulting in wrinkles and folds of the sheet material (E5), which affects the smoothness of pulling the sheet material (E5) to be dispensed later. This situation is particularly obvious when the user pulls the sheet material out with one hand, and it will increase the clearance (E4) after long-term use, making the wrinkles and folds more serious.

The wrinkles and folds of the sheet material (E5) may cause the user to apply a larger force to pull the sheet material (E5). As a result, when the desired section of the sheet material (E5) is not fully pulled out, it is torn off unexpectedly. Sometimes, the sheet material (E5) may break inside the box. The sheet material (E5) needs to be reinstalled. It is quite inconvenient for use.

SUMMARY OF THE INVENTION

According to an embodiment of the present invention, a rolled sheet material dispenser is provided. The rolled sheet material dispenser is used for dispensing a sheet material on a reel. The rolled sheet material dispenser comprises a box and a clamping assembly. The box defines an accommodating space therein and a dispensing opening communicating with the accommodating space. The clamping assembly includes a first clamping member, a second clamping member, and at least one elastic member. The first clamping member or/and the second clamping member may be a roller. The roller is pivotally connected to the box through a pair of rolling bearings and adjacent to the dispensing opening. The roller is connected with the elastic member so that the roller can be displaced by an elastic force of the elastic member to a clamping position and can be supported by the rolling bearings to clamp the sheet material stably.

Preferably, the rolling bearings each include an inner ring, an outer ring, and a plurality of rolling elements. The rolling elements are disposed between the inner ring and the outer ring. The inner ring is sleeved on a shaft portion of the roller.

Preferably, the box includes a cover and a seat. The accommodating space is defined between the cover and the seat. The cover has an end edge and a pivot portion adjacent to the end edge. The pivot portion is pivotally connected to a first end portion of the seat to define the dispensing opening between the end edge and the first end portion.

Preferably, the seat is provided with a pair of movable pivot seats adjacent to the first end portion. The first clamping member is a roller pivotally connected to the pair of movable pivot seats through the pair of rolling bearings.

Preferably, the seat is provided with a pair of accommodating slots adjacent to the first end portion. The pair of movable pivot seats is movably disposed in the pair of accommodating slots, respectively. Each of the accommodating slots is provided with the elastic member. The elastic force is indirectly applied to the first clamping member via the movable pivot seats.

Preferably, the second clamping member is a roller pivotally connected to the cover through another pair of rolling bearings.

Preferably, the cover has a coupling portion opposite to the end edge. The coupling portion is detachably coupled to a second end portion of the seat opposite the first end portion.

Preferably, the seat includes a pair of side plates. A rotating shaft of the reel is pivotally mounted to the pair of side plates. The cover has a pair of clamping portions. When the cover is closed relative to the seat, the clamping portions of the cover clamp the pair of side plates to displace the pair of side plates to a predetermined position.

Preferably, the side plates of the seat each have a guiding slot. The guiding slot has an inlet end and an opposite closed end. The inlet end communicates with an opening of the seat for the rotating shaft of the reel to be inserted into the guiding slot from the inlet end to the closed end to form a pivot.

According to another embodiment of the present invention, a rolled sheet material dispenser is provided. The rolled sheet material dispenser is used for dispensing a sheet material on a reel. The sheet material is made of a dry non-woven fabric. The rolled sheet material dispenser comprises a box and a clamping assembly. The box includes a cover and a seat. An accommodating space is defined between the cover and the seat. The seat is provided with a pair of movable pivot seats adjacent to a first end portion of the seat. The seat includes a pair of side plates. A rotating shaft of the reel is pivotally mounted to the pair of side plates. The cover has an end edge, a pivot portion adjacent to the end edge, and a pair of clamping portions. A dispensing opening is defined between the end edge and the first end portion. The dispensing opening communicates with the accommodating space. The pivot portion is pivotally connected to the first end portion of the seat. When the cover is closed relative to the seat, the clamping portions of the cover clamp the pair of side plates to displace the pair of side plates to a predetermined position. The clamping assembly includes a first clamping member, a second clamping member, and at least one elastic member. The first clamping member is a roller pivotally connected to the pair of movable pivot seats through a pair of rolling bearings. The second clamping member is a roller pivotally connected to the cover through another pair of rolling bearings. The roller is a hollow aluminum tube and located adjacent to the dispensing opening. The first clamping member is connected with the elastic member so that the first clamping member can be displaced by an elastic force of the elastic member to a clamping position and can be supported by the rolling bearings to clamp the sheet material stably.

According to the above technical features, the present invention can achieve the following effects:

1. By using the roller in cooperation with the elastic force of the elastic member to clamp the sheet material, the proper clamping effect of the sheet material and the smoothness of pulling the sheet material can be taken into consideration. It is convenient for the user to tear off an appropriate length of the sheet material with one hand, thereby improving the use of the product.

2. The roller is pivotally connected to the box through a pair of rolling bearings, so that the pulling force and the tearing force can be uniformly dispersed to clamp the sheet material stably, thereby reducing the possibility that the sheet material is wrinkled due to an improper applied force and thereby enhancing the convenience for the use of the product.

3. Since the roller adopts the rolling bearing for pivoting, there is no need to reserve a clearance between the roller and the rolling bearing to increase the smoothness of rotation. Therefore, when the user applies a force to tear off the sheet material, the sheet material will not have wrinkles. In particular, when the user tears off the sheet material with one hand, it is also possible to effectively prevent the eccentric displacement of the roller and further to avoid wrinkles on the sheet material.

4. Since the roller adopts the rolling bearing for pivoting, the initial resistance of the rotation of the roller can be greatly reduced, and the sheet material can be pulled out more easily. It is more labor-saving and smooth for use.

5. Since the roller is displaced to the clamping position by the elastic force of the elastic member, the clamping position can be appropriately adjusted according to the thickness of the sheet material, so as to be suitable for various types of sheet materials. The applicability of the product is improved.

6. Both the first clamping member and the second clamping member may be rollers, and are pivotally connected to the box through the rolling bearings, so that the sheet material can be more stably clamped to further enhance the use of the product.

7. The pivotal joint of the cover is adjacent to the dispensing opening. The dispensing opening is still maintained at a position close to the box when the cover is opened. It is convenient for the user to align the sheet material on the reel with the dispensing opening.

8. The movable pivot seats and the elastic member provide an elastic force to act on the roller for the product to be assembled and implemented easily.

9. When the cover is closed, the side plates can be placed at a predetermined position to prevent the side plates from affecting the overall appearance due to errors.

10. The sheet material may be made of a dry non-woven fabric, so that the problem that a common wet wipe needs to be added with a harmful chemical substance such as a preservative can be avoided.

11. The roller may adopt a hollow aluminum tube that has the advantages of light weight and low friction and appropriate structural strength.

DETAILED DESCRIPTION OF THE PREFERRED EMBODIMENTS

Embodiments of the present invention will now be described, by way of example only, with reference to the accompanying drawings.

Figure 1:
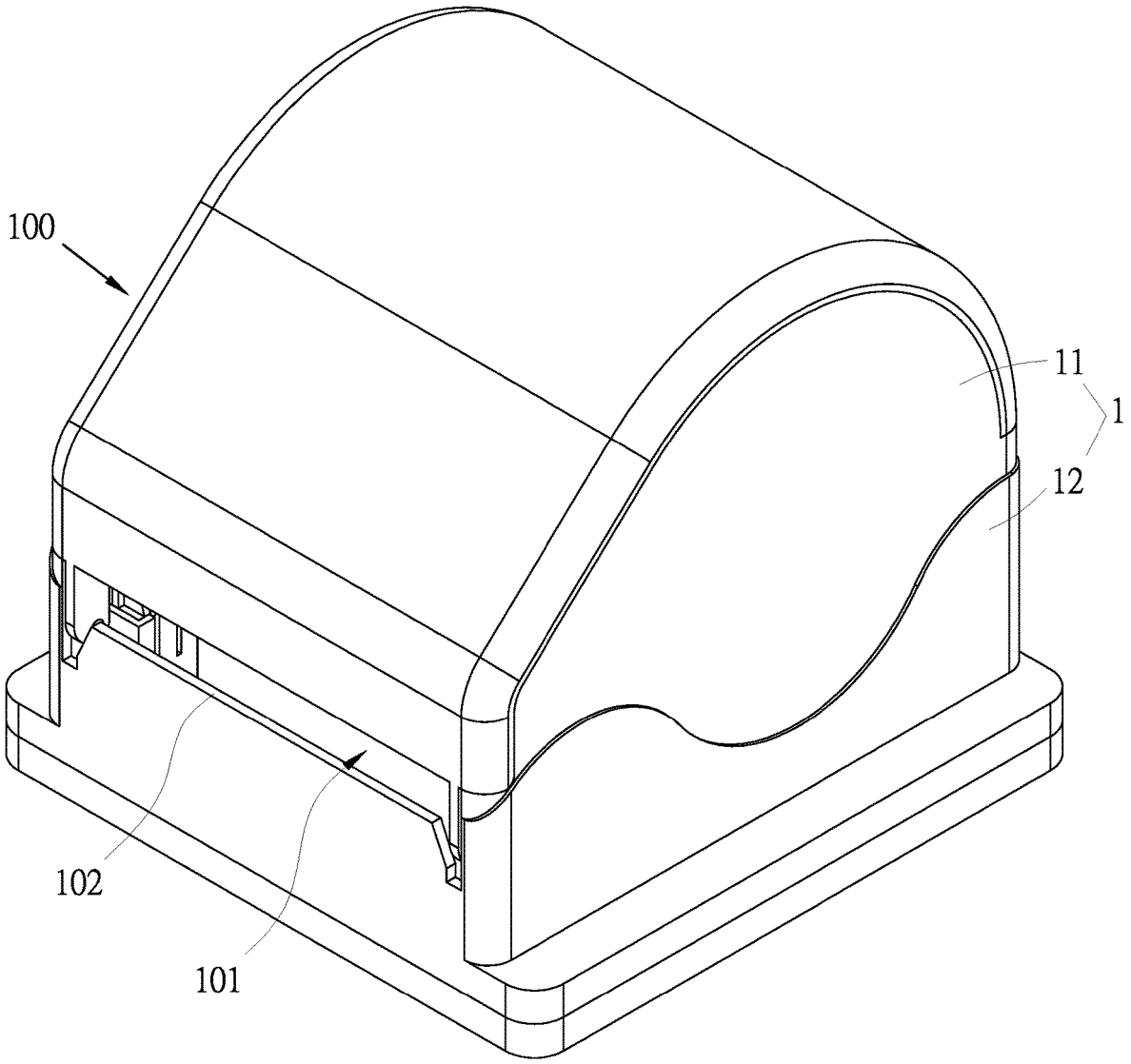
FIG. 1 is a perspective view in accordance with an embodiment of the present invention.

Referring to FIG. 1, a rolled sheet material dispenser (100) according to an embodiment of the present invention comprises a box (1). The box (1) defines an accommodating space (101) therein and a dispensing opening (102) communicating with the accommodating space (101). In the embodiment, the box (1) includes a cover (11) and a seat (12). The accommodating space (101) is defined between the cover (11) and the seat (12).

Figure 2:
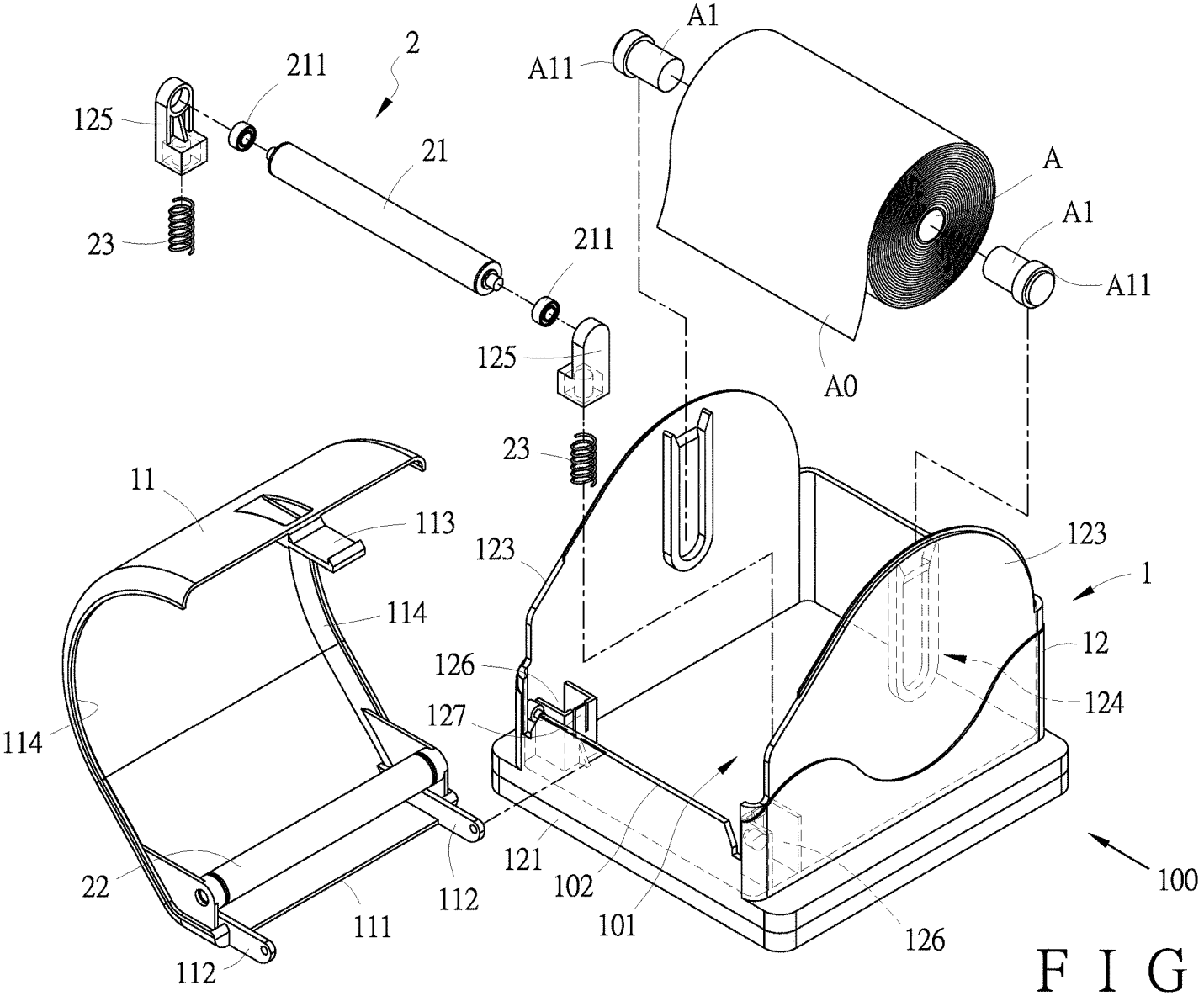
FIG. 2 is an exploded view in accordance with the embodiment of the present invention.

Referring to FIG. 2, the box (1) is used for mounting a reel (A). The reel (A) is used for winding a sheet material (A0). The sheet material (A0) may be made of a dry non-woven fabric, so that the problem that a common wet wipe needs to be added with a harmful chemical substance such as a preservative can be avoided, but it is not limited thereto, and a common sheet-like wiping material such as paper can be used. In detail, the reel (A) is mounted to the seat (12) through at least one rotating shaft (A1). In the embodiment, two sides of the reel (A1) are coupled with the rotating shafts (A1). The rotating shaft (A1) has a contact surface (A11). The contact surface (A11) is configured to abut against the seat (12) to increase the frictional resistance of the rotating shaft (A1), thereby avoiding the unexpected rotation of the reel (A).

Figure 3:
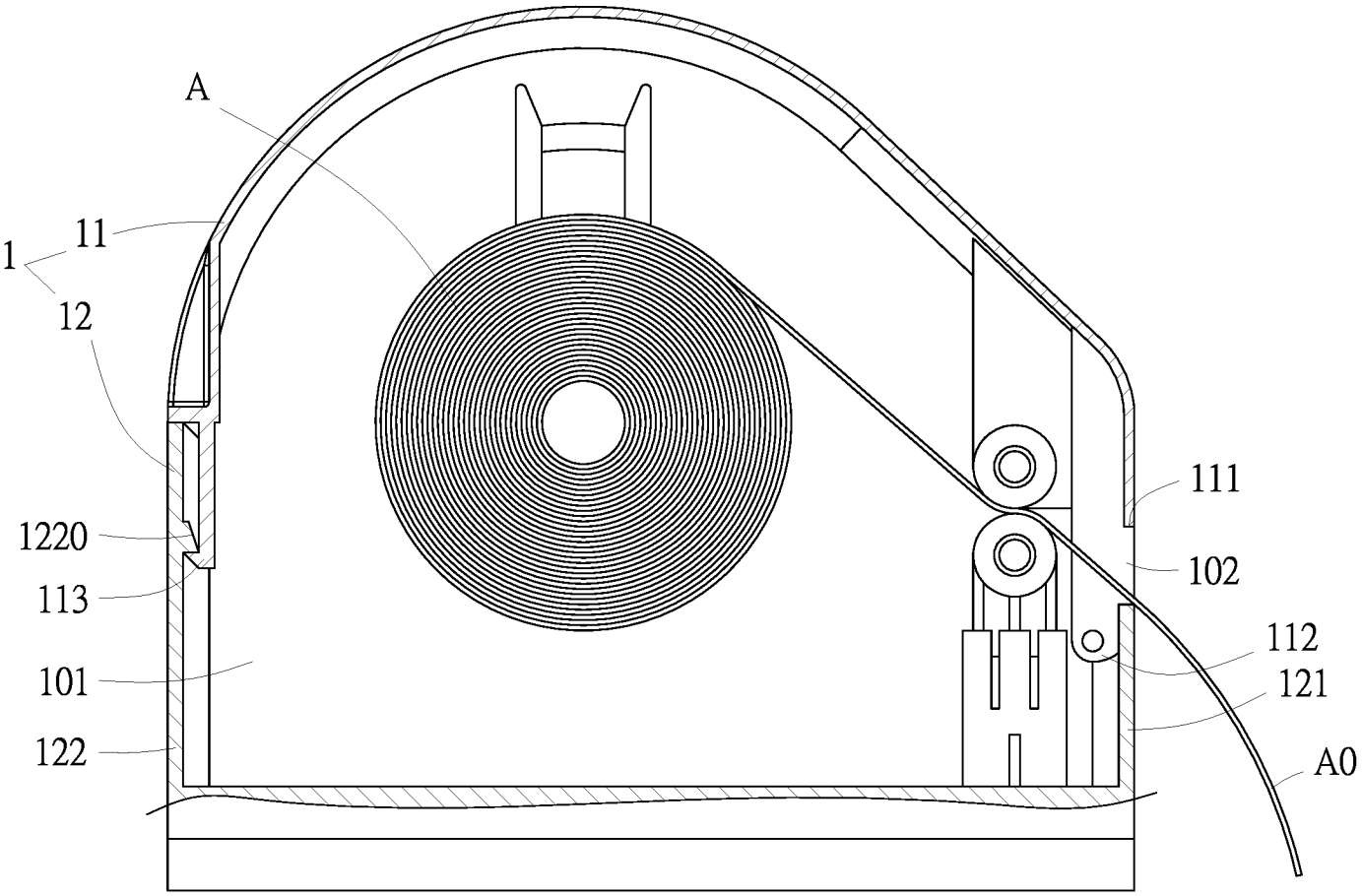
FIG. 3 is a side sectional view in accordance with the embodiment of the present invention.

Referring to FIG. 2 and FIG. 3, the cover (11) is mounted to the seat (12) in a flipable manner. Specifically, the cover (11) may have one end edge (111) and a plurality of pivot portions (112) adjacent to the end edge (111). The pivot portions (112) are pivotally connected to a first end portion (121) of the seat (12) to define the dispensing opening (102) between the end edge (111) and the first end portion (121). The cover (11) has a coupling portion (113) opposite to the end edge (111). The coupling portion (113) may be, for example, a buckle portion, and is detachably fastened to another buckle portion (1220) on a second end portion (122) of the seat (12) opposite the first end portion (121), but not limited thereto. For example, it can be retained by a detachable structure such as magnetic attraction.

Figure 4:
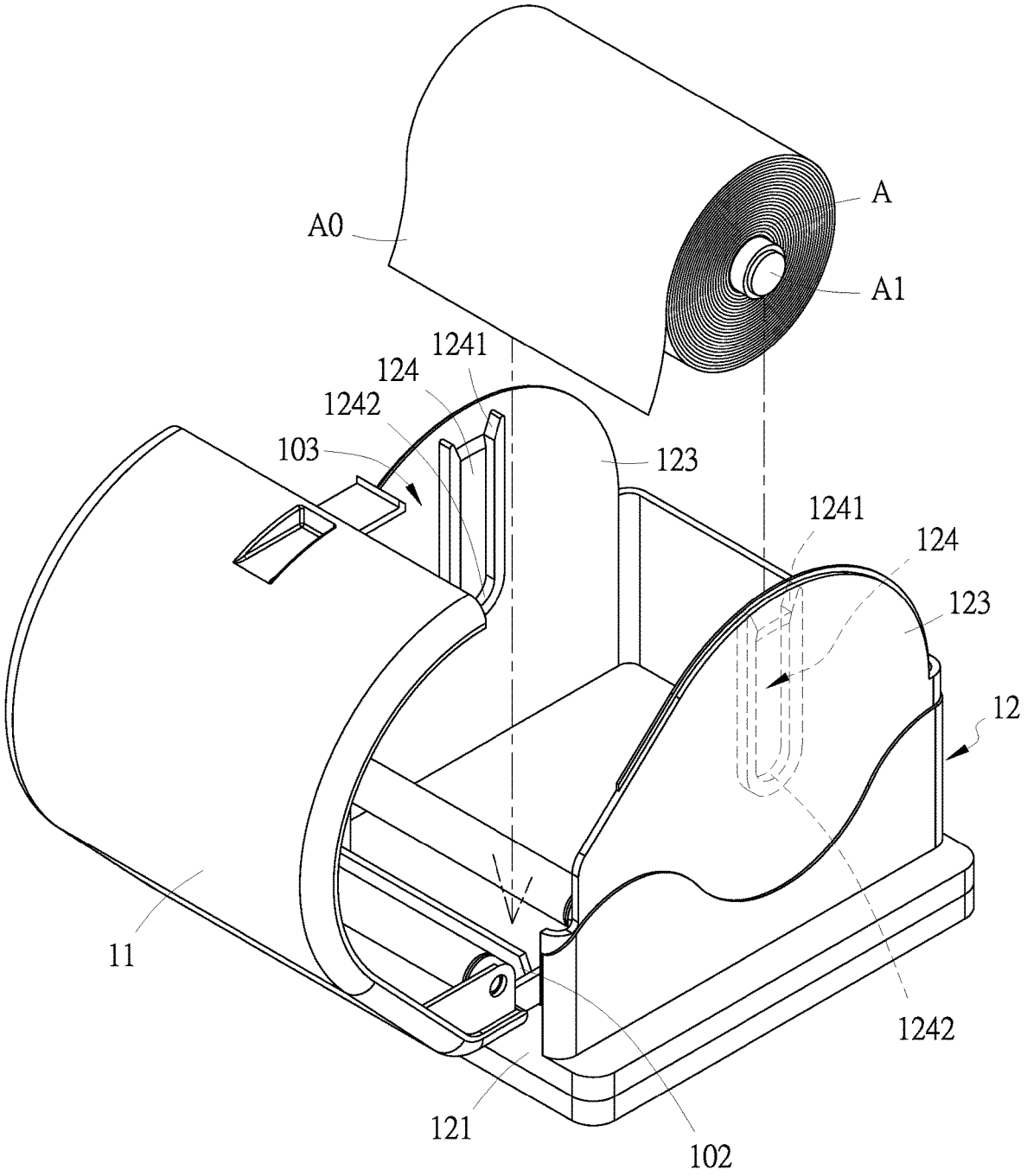
FIG. 4 is a schematic view showing the installation of the reel in accordance with the embodiment of the present invention.

Referring to FIG. 4, the seat (12) includes a pair of side plates (123). The rotating shaft (A1) of the reel (A) is pivotally mounted to the pair of side plates (123). On the other hand, since the pivotal joint of the cover (11) is adjacent to the dispensing opening (102), the dispensing opening (102) is still maintained close to the first end portion (121) of the seat (12) when the cover (11) is opened to an open position. It is convenient for the user to align the sheet material (A0) on the reel (A) with the dispensing opening (102).

Figure 5:
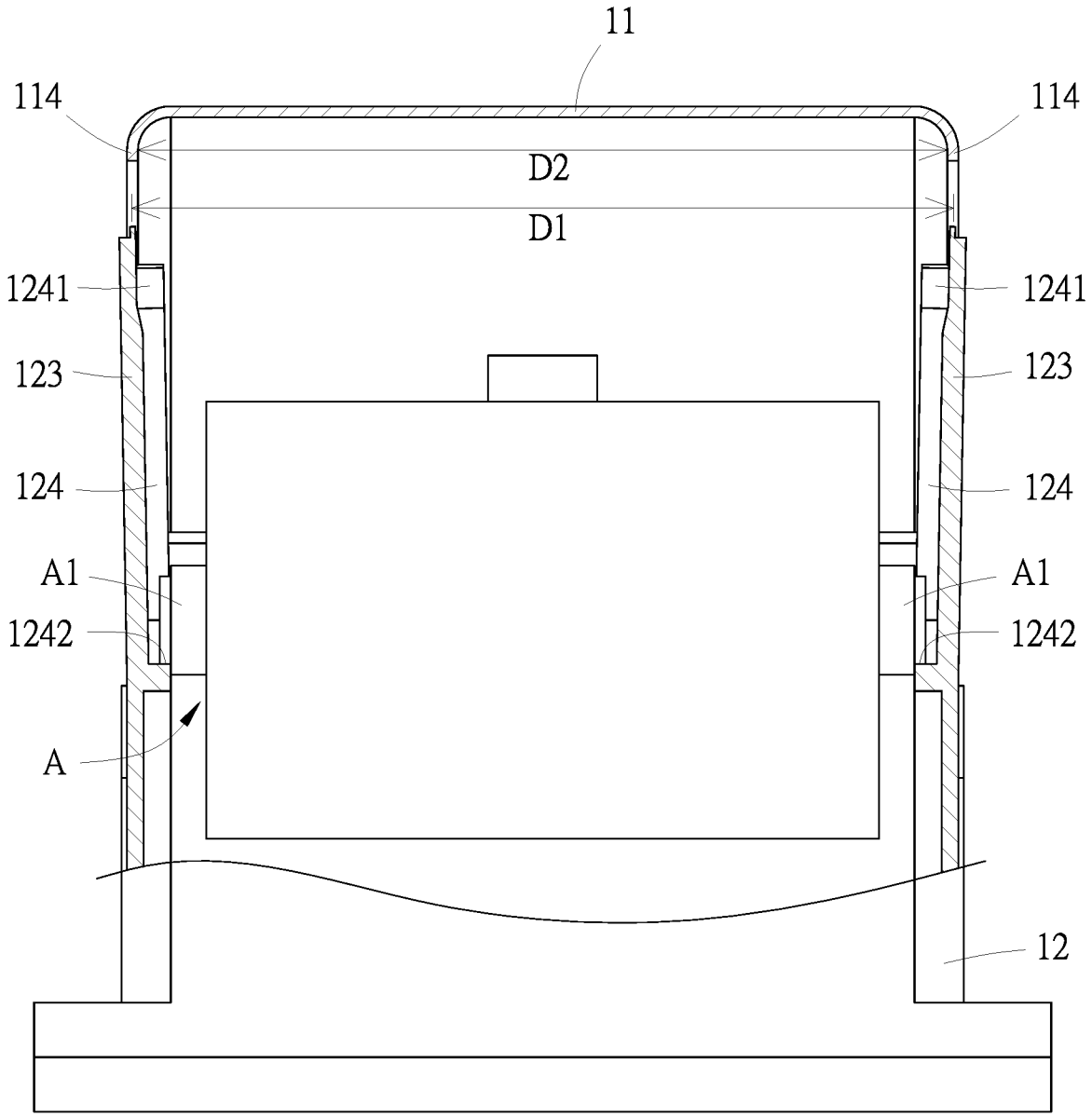
FIG. 5 is a schematic sectional view in accordance with the embodiment of the present invention, showing that the cover is not fully closed.
Figure 6:
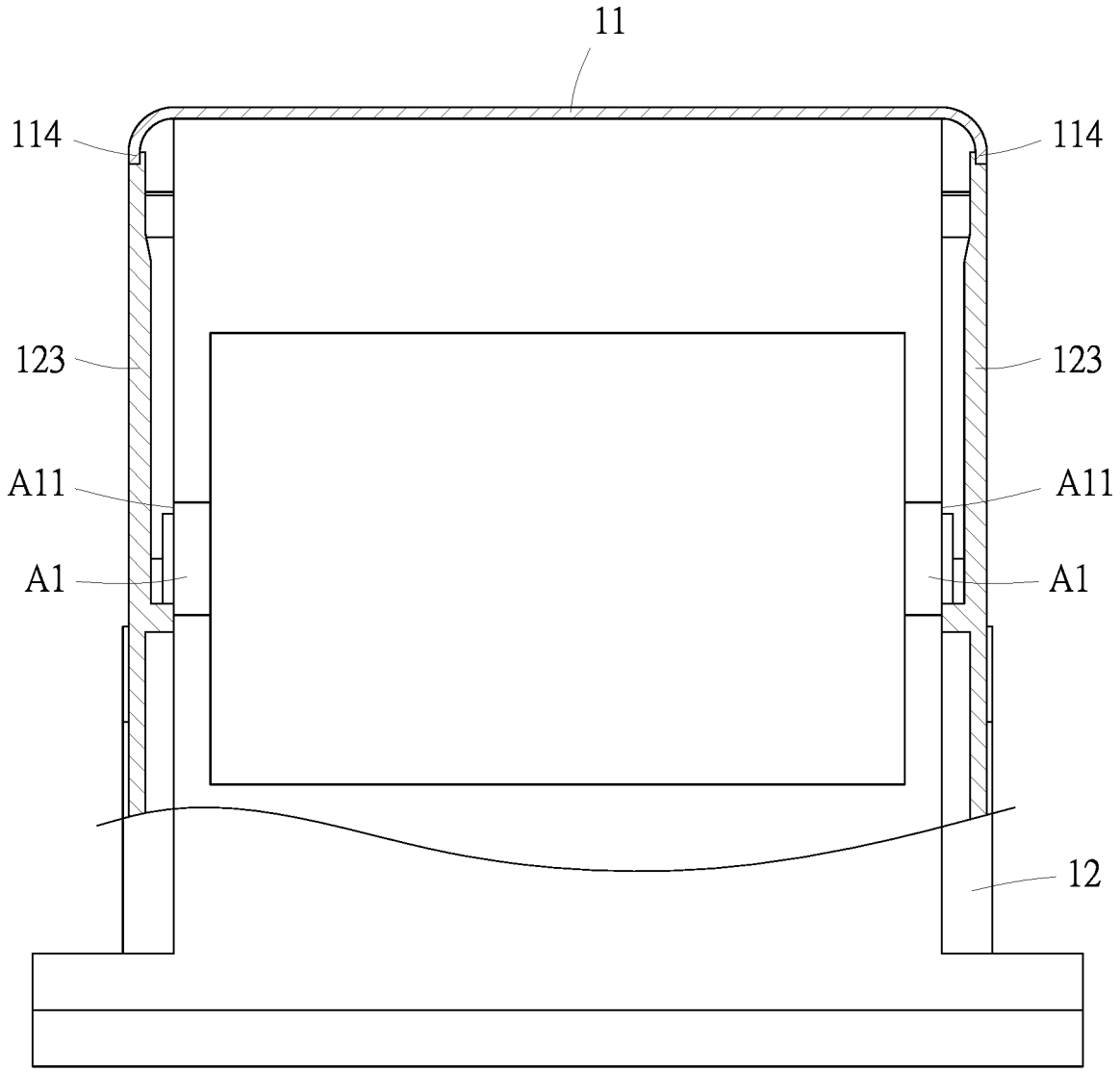
FIG. 6 is a schematic sectional view in accordance with the embodiment of the present invention, showing that the cover is fully closed.

Referring to FIG. 4 and FIG. 5, preferably, the pair of side plates (123) of the seat (12) each have a guiding slot (124). The guiding slot (124) has an inlet end (1241) and an opposite closed end (1242). The inlet end (1241) communicates with an opening (103) of the seat (12) for the rotating shaft (A1) of the reel (A) to be inserted into the guiding slot (124) from the inlet end (1241) to the closed end (1242) to form a pivot. Preferably, the pair of side plates (123) may have a first position that is open relative to each other. When in the first position, a first spacing (D1) is defined between the pair of side plates (123). The cover (11) has a pair of clamping portions (114). A second spacing (D2) is defined between the pair of clamping portions (114). Referring to FIG. 5 and FIG. 6, when the cover (11) is closed relative to the seat (12), the clamping portions (114) of the cover (11) will clamp the pair of side plates (123) to displace the pair of side plates (123) to a predetermined position, thereby preventing the pair of side plates (123) from affecting the overall appearance due to errors (e.g., relative expansion or relative retraction).

Figure 7:
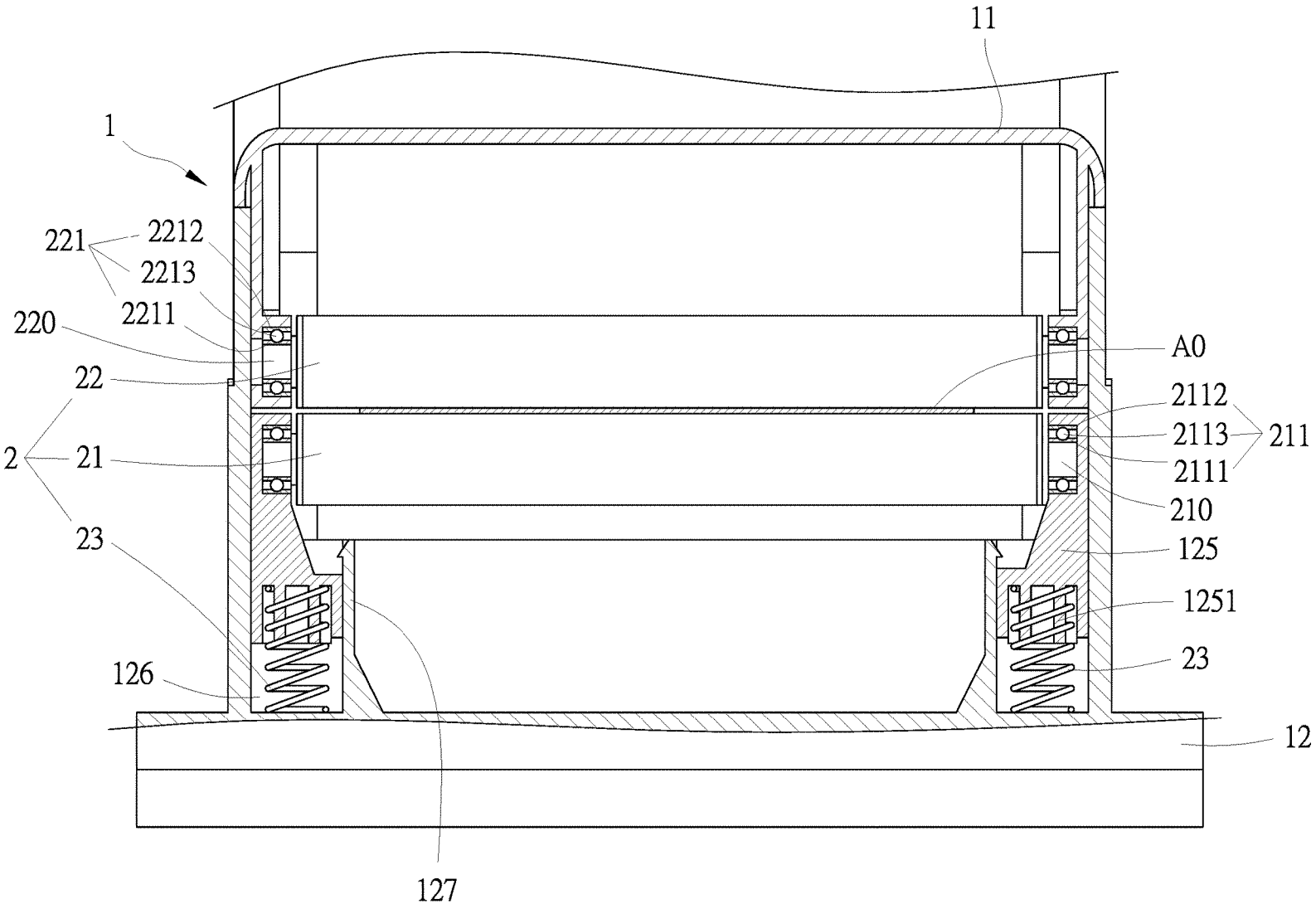
FIG. 7 is a schematic sectional view in accordance with the embodiment of the present invention, showing that the first clamping member and the second clamping member jointly clamp the sheet material.

Referring to FIG. 2 in conjunction with FIG. 7, the rolled sheet material dispenser (100) further comprises a clamping assembly (2). The clamping assembly (2) includes a first clamping member (21), a second clamping member (22), and at least one elastic member (23). In the embodiment, both the first clamping member (21) and the second clamping member (22) are rollers. The roller can adopt a hollow metal tube (for example, a hollow aluminum tube). The rollers are pivotally connected to the box (1) through a pair of rolling bearings (211) (221) and adjacent to the dispensing opening (102), but not limited thereto. For example, one of the first clamping member (21) and the second clamping member (22) may be a roller, and the other of the first clamping member (21) and the second clamping member (22) may be a fixed rod, an end edge, etc. Through a single roller, the smoothness of pulling the sheet material (A0) can be increased. It is to be noted that the rolling bearings (211) (221) may be a ball bearing, a roller bearing or a bearing having other rolling elements. In detail, the rolling bearings (211) (221) each include an inner ring (2111) (2211), an outer ring (2112) (2212), and a plurality of rolling elements (2113) (2213) between the inner ring (2111) (2211) and the outer ring (2112) (2212). The inner ring (2111) (2211) may be sleeved on a shaft portion (210) (220) of the roller. The outer ring (2112) (2212) is embedded in a movable pivot seat (125) described later and the cover (11).

Referring to FIG. 2 in conjunction with FIG. 7, the roller is connected with the elastic member (23), and can be displaced by an elastic force of the elastic member (23) to a clamping position. Through the elastic member (23), the clamping position can be appropriately adjusted according to the thickness of the sheet material (A0). Specifically, in this embodiment, the seat (12) is provided with a pair of movable pivot seats (125) adjacent to the first end portion (121). The first clamping member (21) is pivotally connected to the pair of movable pivot seats (125) through a pair of rolling bearings (211). The elastic member (23) is a spring fitted on a protruding post (1251) of the movable pivot seat (125). In detail, the seat (12) is provided with a pair of accommodating slots (126) adjacent to the first end portion (121) and a pair of limiting latches (127) adjacent to the accommodating slots (126), respectively. The pair of movable pivot seats (125) are movably disposed in the pair of accommodating slots (126) respectively and are limited by the pair of limiting latches (127), thereby facilitating installation or disassembly of the movable pivot seats (125). Each of the accommodating slots (126) is provided with the elastic member (23). The elastic force is indirectly applied to the first clamping member (21) via the movable pivot seats (125). The second clamping member (22) is pivotally connected to the cover (11) through another pair of rolling bearings (221). The second clamping member (22) can only be pivoted in this embodiment, but can be implemented as the first clamping member (21) that is movable and connected with the elastic member (23).

Figure 8:
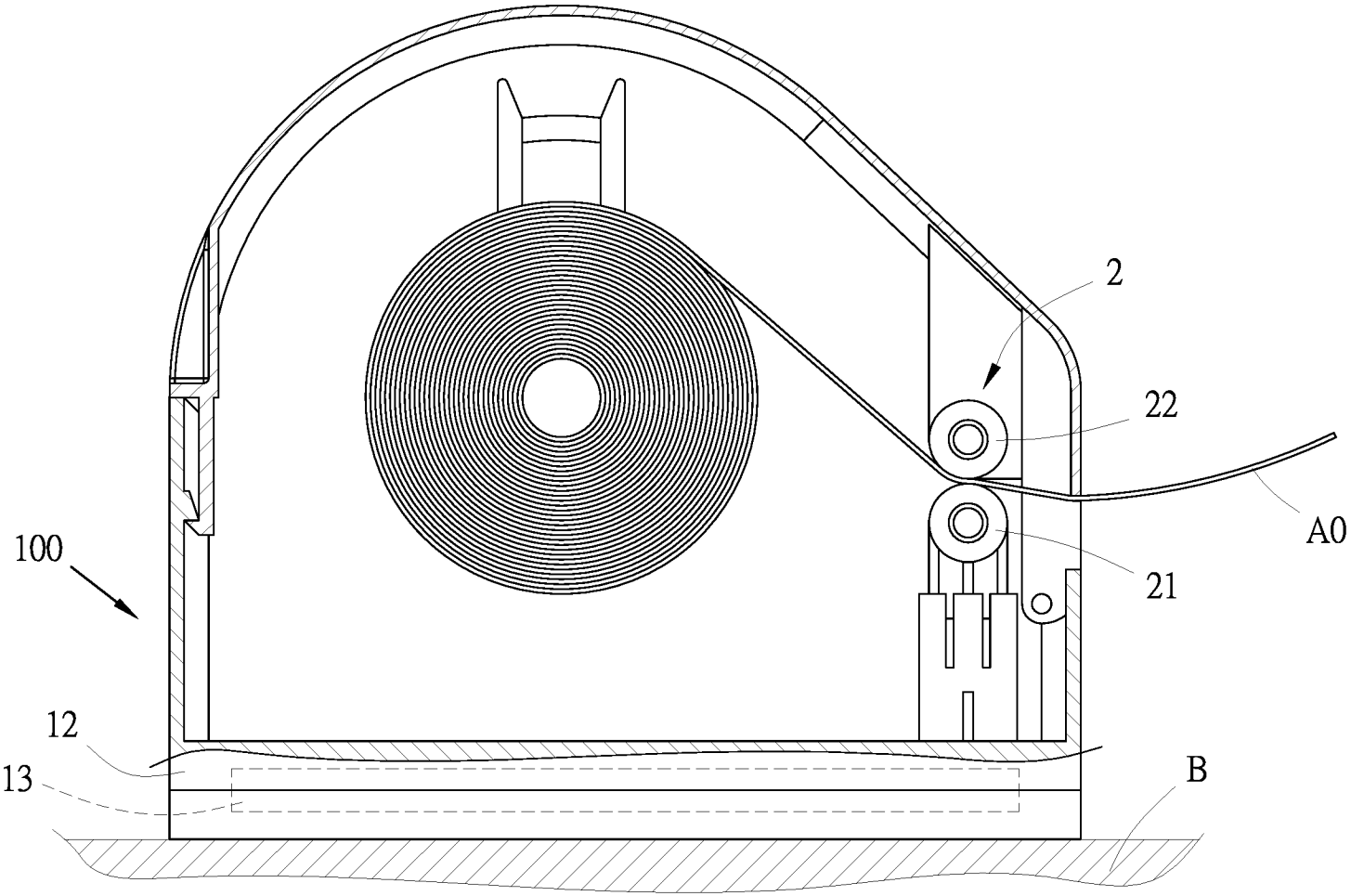
FIG. 8 is a schematic sectional view in accordance with the embodiment of the present invention, showing that a section of the sheet material is pulled out.

When in use, referring to FIG. 7 and FIG. 8, the first clamping member (21) of the clamping assembly (2) is subjected to the elastic member (23) when the sheet material (A0) is pulled out. The first clamping member (21) cooperates with the second clamping member (22) to effectively clamp the sheet material (A0). After the user pulls the sheet material (A0) out for a desired length, the sheet material (A0) can be torn. When the pulling force is greater than the bonding force of the tear line, a section of the sheet material (A0) can be torn off. During the pulling process, since the roller is pivotally connected to the box (1) through a pair of rolling bearings (211) (221), the pulling force and the tearing force can be uniformly dispersed so that the clamping assembly (2) can stably clamp the sheet material (A0) to reduce the possibility that the sheet material (A0) is wrinkled due to an improper applied force, thereby enhancing the convenience for the use of the product.

Figure 9:
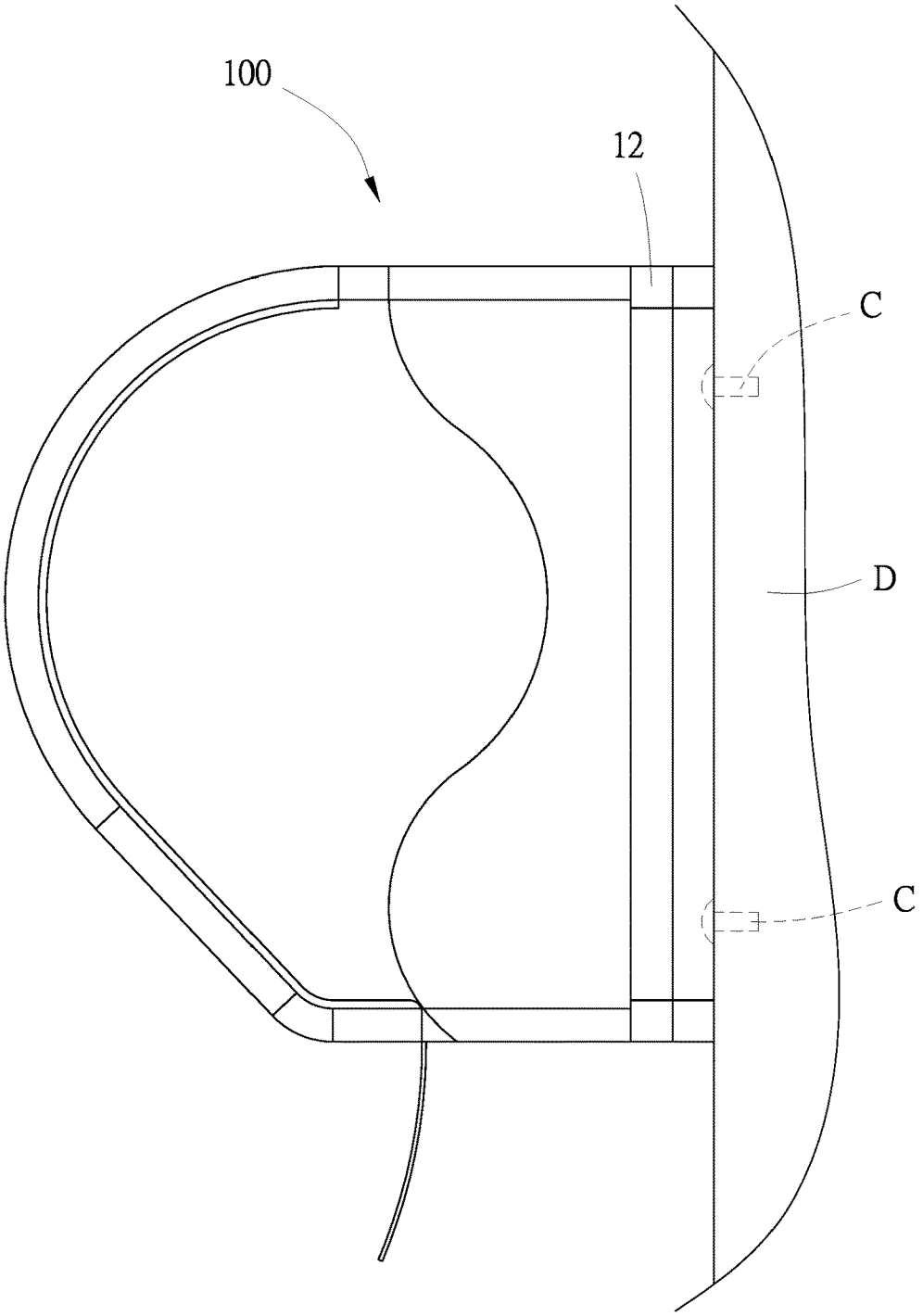
FIG. 9 is a side view in accordance with the embodiment of the present invention mounted to the wall.
Figure 10A:
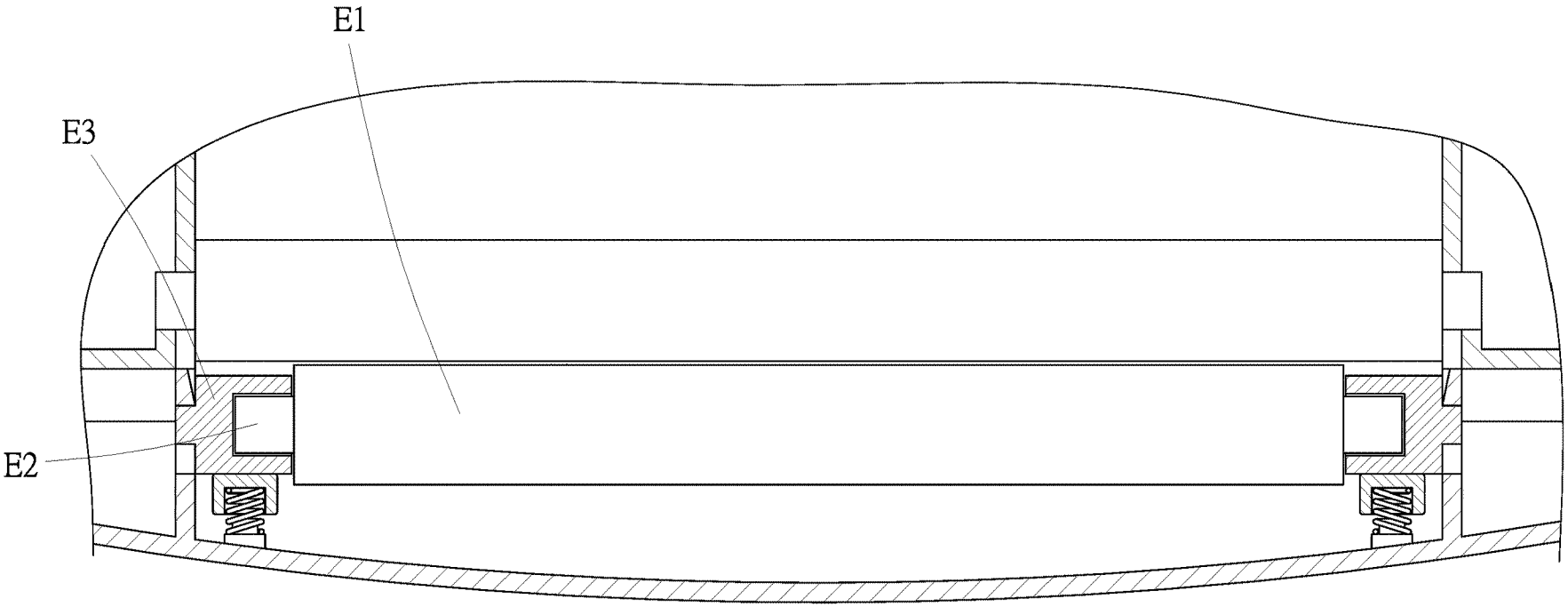
FIG. 10A is a schematic top sectional view, referring to FIG. 8A and FIG. 8B of Taiwan Patent Publication No. I231199.
Figure 10B:
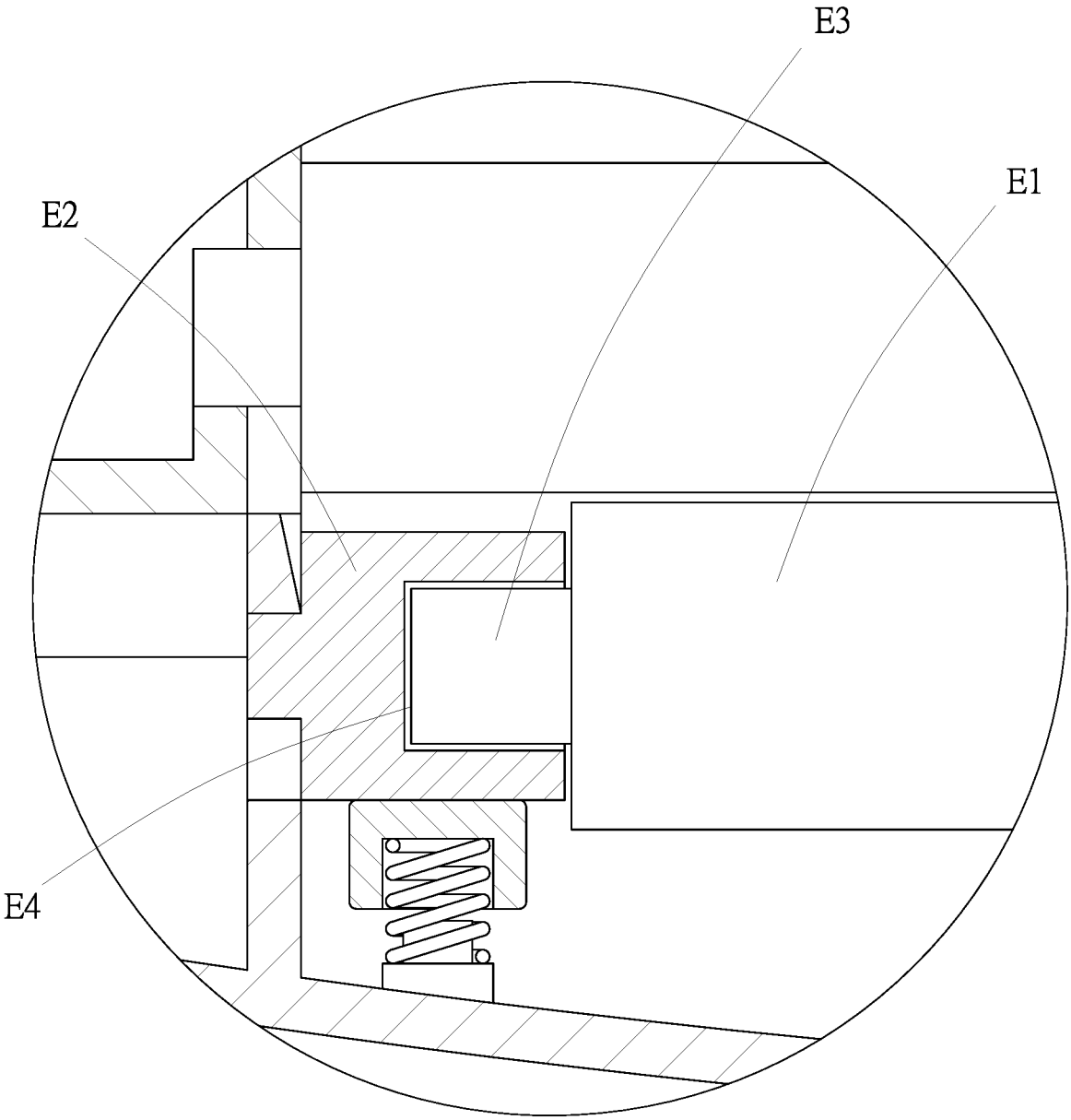
FIG. 10B is a partially enlarged view of FIG. 10A.
Figure 11A:
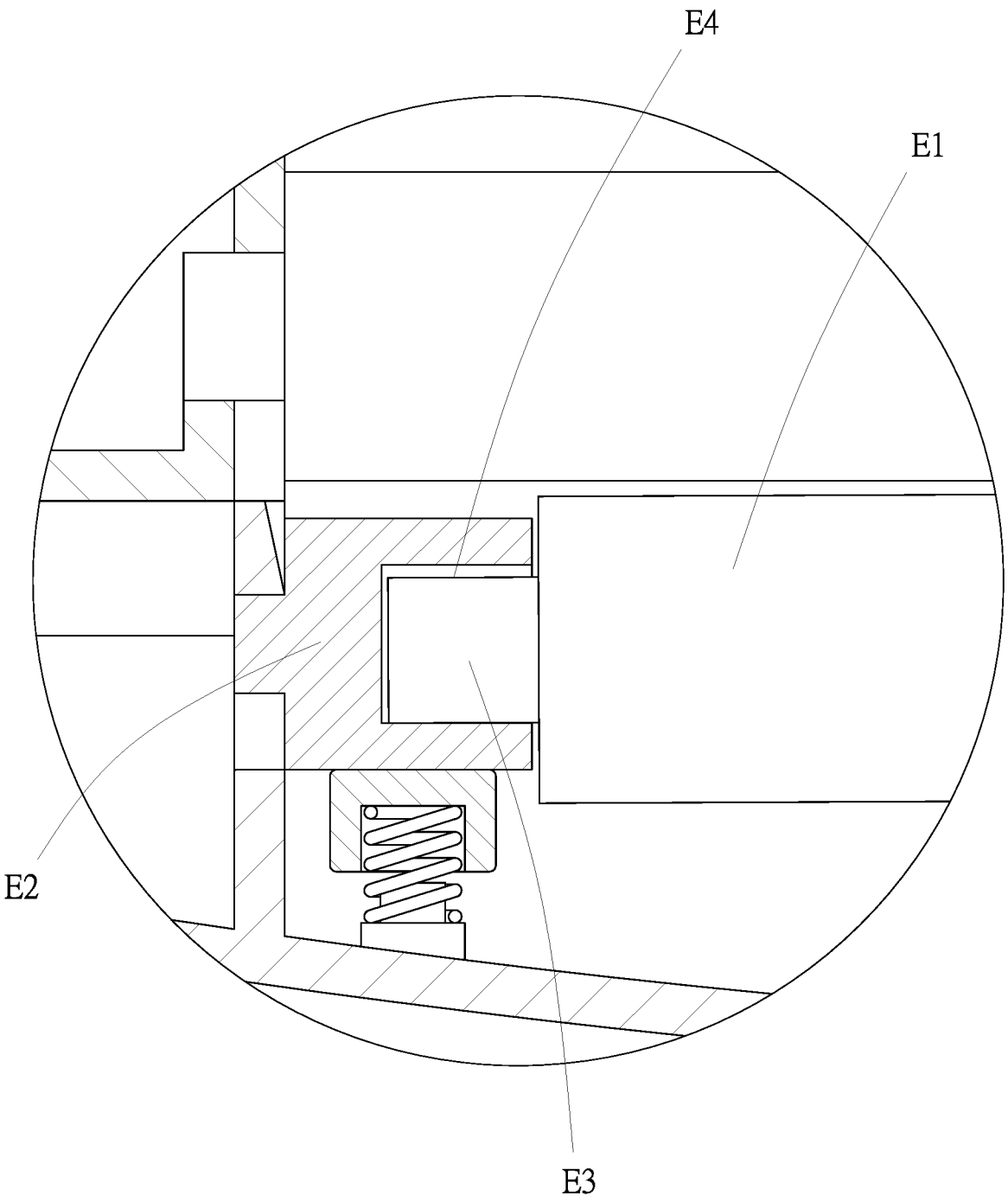
FIG. 11A is a partially enlarged view showing the eccentric displacement of the pivot of FIG. 10A.
Figure 11B:
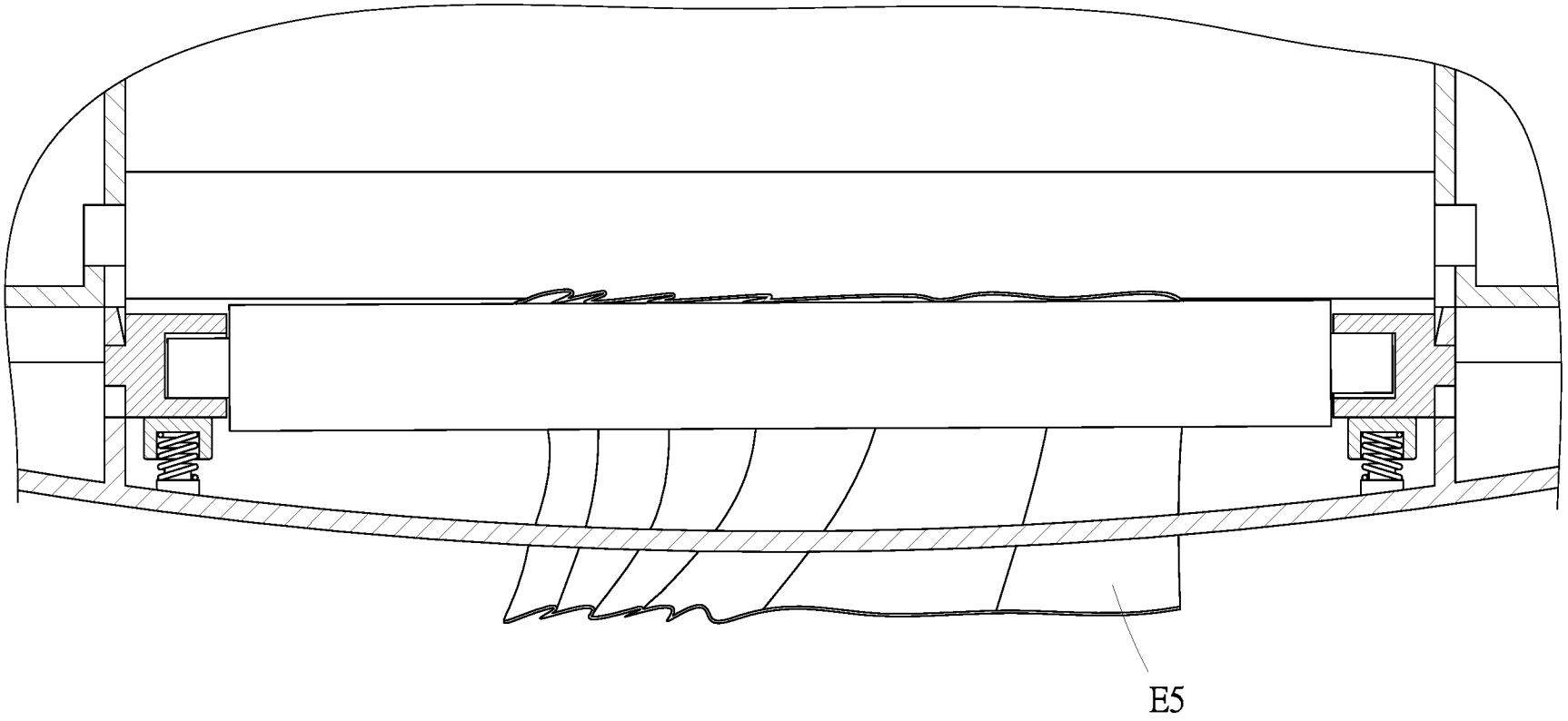
FIG. 11B is a schematic view of FIG. 10A, showing the state of use when the pivot is displaced eccentrically.

Referring to FIG. 8, when the rolled sheet material dispenser (100) is placed, the seat (12) can be placed substantially flat on a surface such as a table top (B). The seat (12) may be combined with a counterweight (13) having an appropriate weight, but not limited thereto. As shown in FIG. 9, the rolled sheet material dispenser (100) may be fixed to a surface such as a wall surface (D) by using a plurality of fasteners (C). The main purpose is to avoid the undesired displacement of the seat (12) to affect its usability.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A rolled sheet material dispenser, used for dispensing a sheet material on a reel, comprising:

a box defining an accommodating space therein and a dispensing opening communicating with the accommodating space, the box including a cover and a seat, and the accommodating space being disposed between the cover and the seat, the cover having an end edge and a pivot portion adjacent to the end edge, the pivot portion being pivotally connected to a first end portion of the seat to form the dispensing opening between the end edge and the first end portion, the seat being provided with a pair of movable pivot seats adjacent to the first end portion; and a clamping assembly, including a first clamping member, a second clamping member and at least one elastic member, the first clamping member being a roller, the roller being pivotally connected to the pair of movable pivot seats through a pair of rolling bearings and adjacent to the dispensing opening, the roller being connected with the elastic member so that the roller can be displaced by an elastic force of the elastic member to a clamping position and can be supported by the rolling bearings to clamp the sheet material stably.

2. The rolled sheet material dispenser as claimed in claim 1, wherein the rolling bearings each include an inner ring, an outer ring and a plurality of rolling elements, the plurality of rolling elements are disposed between the inner ring and the outer ring, and the inner ring is sleeved on a shaft portion of the roller.

3. The rolled sheet material dispenser as claimed in claim 1, wherein the seat is provided with a pair of accommodating slots adjacent to the first end portion, the pair of movable pivot seats are movably disposed in the pair of accommodating slots respectively, each of the accommodating slots is provided with the elastic member, and the elastic force is indirectly applied to the first clamping member via the movable pivot seats.

4. The rolled sheet material dispenser as claimed in claim 1, wherein the second clamping member is a roller pivotally connected to the cover through another pair of rolling bearings.

5. The rolled sheet material dispenser as claimed in claim 1, wherein the cover has a coupling portion opposite to the end edge, the coupling portion is detachably coupled to a second end portion of the seat opposite the first end portion.

6. The rolled sheet material dispenser as claimed in claim 5, wherein the seat includes a pair of side plates, a rotating shaft of the reel is pivotally mounted to the pair of side plates; the cover has a pair of clamping portions, when the cover is closed relative to the seat, the clamping portions of the cover clamp the pair of side plates to displace the pair of side plates to a predetermined position.

7. The rolled sheet material dispenser as claimed in claim 6, wherein the pair of side plates of the seat each have a guiding slot, the guiding slot has an inlet end and an opposite closed end, the inlet end communicates with an opening of the seat for the rotating shaft of the reel to be inserted into the guiding slot from the inlet end to the closed end to form a pivot.

8. A rolled sheet material dispenser, used for dispensing a sheet material on a reel, the sheet material being made of a dry non-woven fabric, the rolled sheet material dispenser comprising:

a box, including a cover and a seat, an accommodating space being defined between the cover and the seat, the seat being provided with a pair of movable pivot seats adjacent to a first end portion of the seat, the seat including a pair of side plates, a rotating shaft of the reel being pivotally mounted to the pair of side plates, the cover having an end edge, a pivot portion adjacent to the end edge and a pair of clamping portions, a dispensing opening being defined between the end edge and the first end portion, the dispensing opening communicating with the accommodating space, the pivot portion being pivotally connected to the first end portion of the seat, wherein when the cover is closed relative to the seat, the clamping portions of the cover clamp the pair of side plates to displace the pair of side plates to a predetermined position; and a clamping assembly, including a first clamping member, a second clamping member and at least one elastic member, the first clamping member being a roller pivotally connected to the pair of movable pivot seats through a pair of rolling bearings, the second clamping member being a roller pivotally connected to the cover through another pair of rolling bearings, the roller being a hollow aluminum tube and located adjacent to the dispensing opening, the first clamping member being connected with the elastic member so that the first clamping member can be displaced by an elastic force of the elastic member to a clamping position and can be supported by the rolling bearings to clamp the sheet material stably.

* * * * *